United States Patent [19]

Beatty

[11] 4,412,602

[45] Nov. 1, 1983

[54] BRAKING SYSTEM FOR RAILWAY TRUCK

[75] Inventor: William T. Beatty, Oakwood, Ga.

[73] Assignee: Rail-Or-Trail Corp., Gainesville, Ga.

[21] Appl. No.: 302,954

[22] Filed: Sep. 16, 1981

[51] Int. Cl.[3] ..... B61A 13/24

[52] U.S. Cl. ..... 188/53; 105/182 R

[58] Field of Search ..... 188/45, 49, 52, 53, 188/54, 55, 56; 105/182 R

[56] References Cited

U.S. PATENT DOCUMENTS

| | | | |
|---|---|---|---|
| 369,847 | 9/1887 | Faneuff | 188/53 |
| 577,768 | 2/1897 | Maechling | 188/53 X |
| 1,147,036 | 7/1915 | Moore | 188/53 |
| 1,921,599 | 8/1933 | Aurien | 188/56 |
| 1,939,106 | 12/1933 | Clouser | 188/53 |
| 2,120,323 | 6/1938 | Craig | 188/46 X |
| 2,124,056 | 2/1938 | Doud et al. | 188/53 |
| 2,166,858 | 2/1939 | Bogatti | 105/182 R |
| 2,211,150 | 8/1940 | Mueller | 188/56 |
| 2,317,156 | 4/1943 | Travilla, Jr. et al. | 188/56 |
| 2,354,016 | 7/1944 | Haynes | 105/182 R |
| 2,657,771 | 11/1953 | Schettler | 188/54 X |
| 2,788,865 | 4/1957 | Kolesa | 188/46 X |
| 3,036,666 | 5/1962 | Schlosser, Jr. | 188/56 X |
| 3,330,387 | 7/1967 | Newell | 188/52 X |
| 4,108,080 | 8/1978 | Garner et al. | 105/182 R X |

*Primary Examiner*—George E. A. Halvosa
*Attorney, Agent, or Firm*—B. J. Powell

[57] ABSTRACT

A braking system for a railway truck including a pair of brake assemblies, each adapted to brake the wheels on opposite sides of the truck. Each of the brake assemblies includes a pair of crank members pivoted on the truck with brake shoes to engage the wheels, a drive link with one end connected directly to one of the crank members and the other end connected to the other crank member through a motion reversing linkage, and a brake cylinder with a reciprocal brake rod pivotally connected to the drive link equidistant from its ends so that equal braking forces are applied to the wheels as the brake rod moves the drive link to pivot the crank members in opposite directions. A hand brake connection assembly is also disclosed to allow the crank members to be manually pivoted to brake the wheels.

4 Claims, 4 Drawing Figures

10
11
12
14
15
16
18
20
24
25
26
30
31
32
34
35
36
38
39
40
41
75
76
80
81
82
84
85
86
92
95
CB

FIG 3
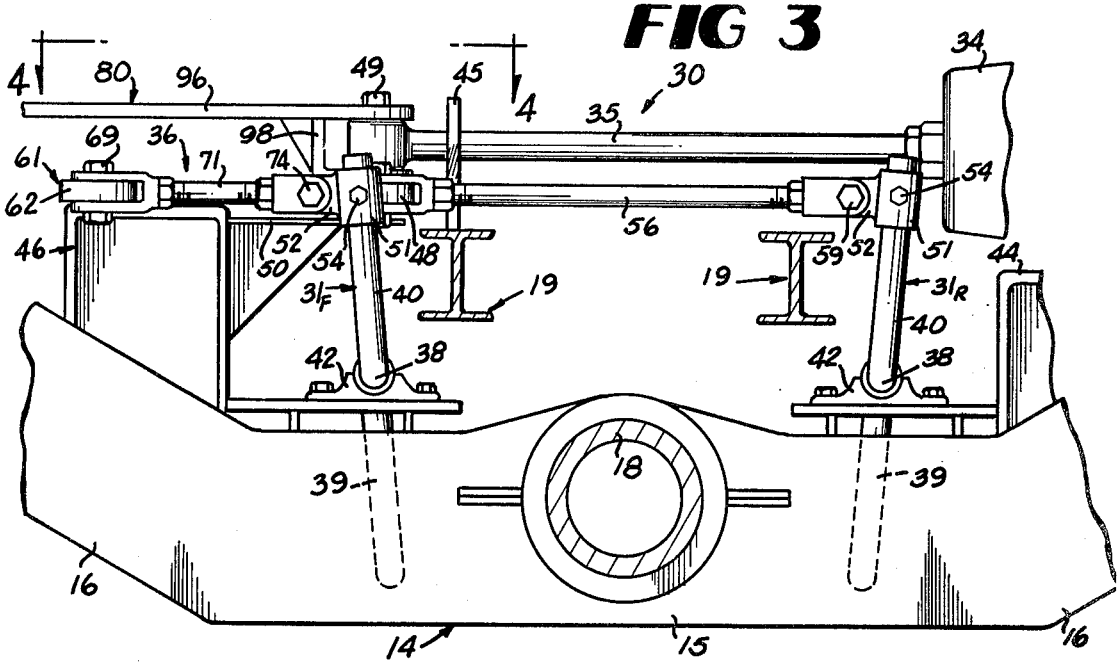
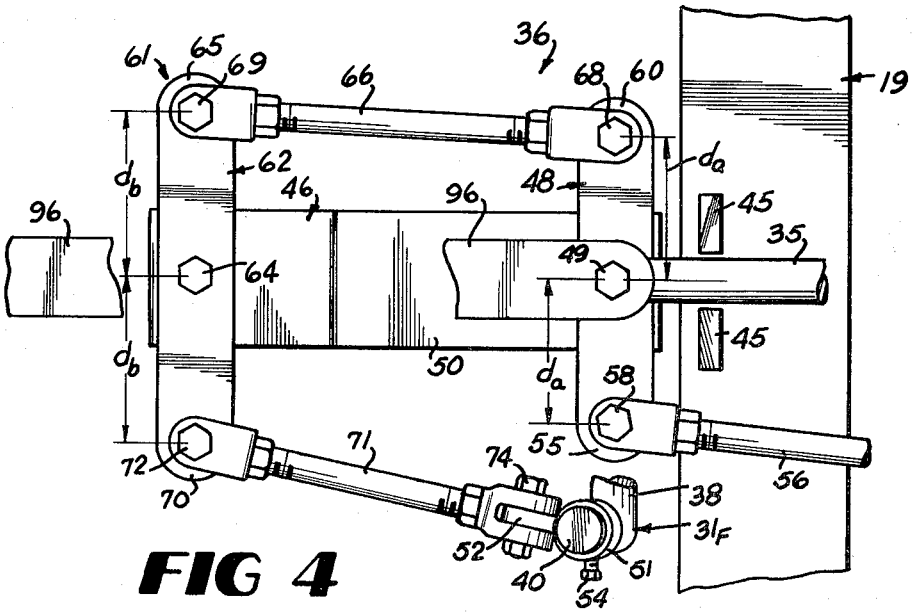
FIG 4

BRAKING SYSTEM FOR RAILWAY TRUCK

BACKGROUND OF THE INVENTION

This invention relates generally to railway trucks and more particularly to a braking system for railway trucks.

Railway trucks require braking systems in order to stop the railway car mounted on the trucks. Typically, such braking systems utilize a pair of spaced apart drive assemblies mounted between the side frames of the truck with a pair of brake cylinders interconnecting the two drive assemblies to provide the braking force between the brake shoes and wheels. This braking system requires that the space between the side frames remain unobstructed in order that the drive assemblies can be accommodated between the side frames. This requirement serves to limit the permissible configurations that can be used for the side frames and also prevents interconnection of the side frames intermediate their ends as is frequently desirable. Thus, these prior art braking systems prevented the use of desired truck configurations.

SUMMARY OF THE INVENTION

These and other problems and disadvantages associated with the prior art are overcome by the invention disclosed herein by providing a braking system for railway trucks which does not limit the configuration of the side frames of the truck and which permits interconnection of the side frames intermediate their ends. The braking system lies in a generally horizontal plane above the side frames and the truck bolster so as not to interfere with the operation thereof, yet still provides the necessary braking forces to stop the railway car. A separate braking assembly is provided for opposite sides of the truck so that the middle of the truck is left unobstructed by the braking system, thereby permitting a wide variety of side frame configurations.

The apparatus of the invention includes a pair of brake assemblies positioned along opposite sides of the railway truck just inboard of the wheels with each of the brake assemblies serving to provide the braking forces for the wheels on one side of the railway truck. Each of the brake assemblies includes a pair of crank members which are pivotally mounted on the side frame with each having a mounting portion that extends into the space between the adjacent wheels on the side of the truck and a drive leg which projects above the side frame inboard of the wheels. A brake shoe is mounted on each of the mounting portions of the crank members so that the brake shoes can be moved into and out of engagement with the wheels as the crank members are pivoted in opposite directions. Each brake assembly also includes a brake cylinder with a reciprocal brake rod. The brake rod is operatively connected to the drive legs of the crank members in the brake assembly by a linkage assembly so that extension of the brake rod pivots the drive legs on the crank members toward each other to engage the brake shoes with the truck wheels while retraction of the brake rod disengages the brake shoes from the truck wheels.

The linkage assembly includes horizontally oriented drive link with one end connected to the drive leg of one of the crank members with a connecting link and the other end of the drive link connected to the drive portion of the other of the crank members through a motion reversing linkage. The reciprocal brake rod from the brake cylinder is pinned to the drive link intermediate its ends and equidistance from the connections of the drive link to the connecting link and to the motion reversing linkage so that, as the brake rod moves the drive link, the crank members will be pivoted in opposite directions to selectively apply the brake shoes against the wheels on one side of the railway truck.

A hand brake connection assembly may also be provided for connection to the hand brake mechanism normally provided on railway cars to simultaneously apply the brake shoes of both brake assemblies to the wheels on the railway truck. The hand brake connection assembly includes a pair of output links, one being connected to each of the drive links at the same location as the brake rod of the brake cylinder. Each of the output links is connected to a drawbar through an appropriate linkage so that, as the drawbar is horizontally moved, braking forces can be applied to the crank members through the output links. The drawbar is connected to one end of a pivoted motion reversing link with a chain so that, as the motion reversing link is pivoted, equal forces will be applied to the brake shoes through the output links. The opposite end of the motion reversing link is connected to a drive member by a chain which is in turn connected to the hand wheel brake mechanism on the railway car by a chain so that, as the drive member is pivoted by the hand wheel mechanism, the brake shoes can be applied against all of the wheels on the railway truck to brake same.

Other features and advantages of the invention will become more apparent upon consideration of the following description and accompanying drawings wherein like characters of reference designate corresponding parts throughout the several views and in which:

BRIEF DESCRIPTION OF THE DRAWINGS

FIG. 3 is an enlarged view taken generally along line 3—3 in FIG. 2; and FIG. 4 is an enlarged view taken generally along line 4—4 in FIG. 3.

These figures and the following detailed description disclose specific embodiments of the invention; however, it is to be understood that the inventive concepts are not limited thereto since they may be embodied in other forms.

DETAILED DESCRIPTION OF ILLUSTRATIVE EMBODIMENTS

Figure 1:
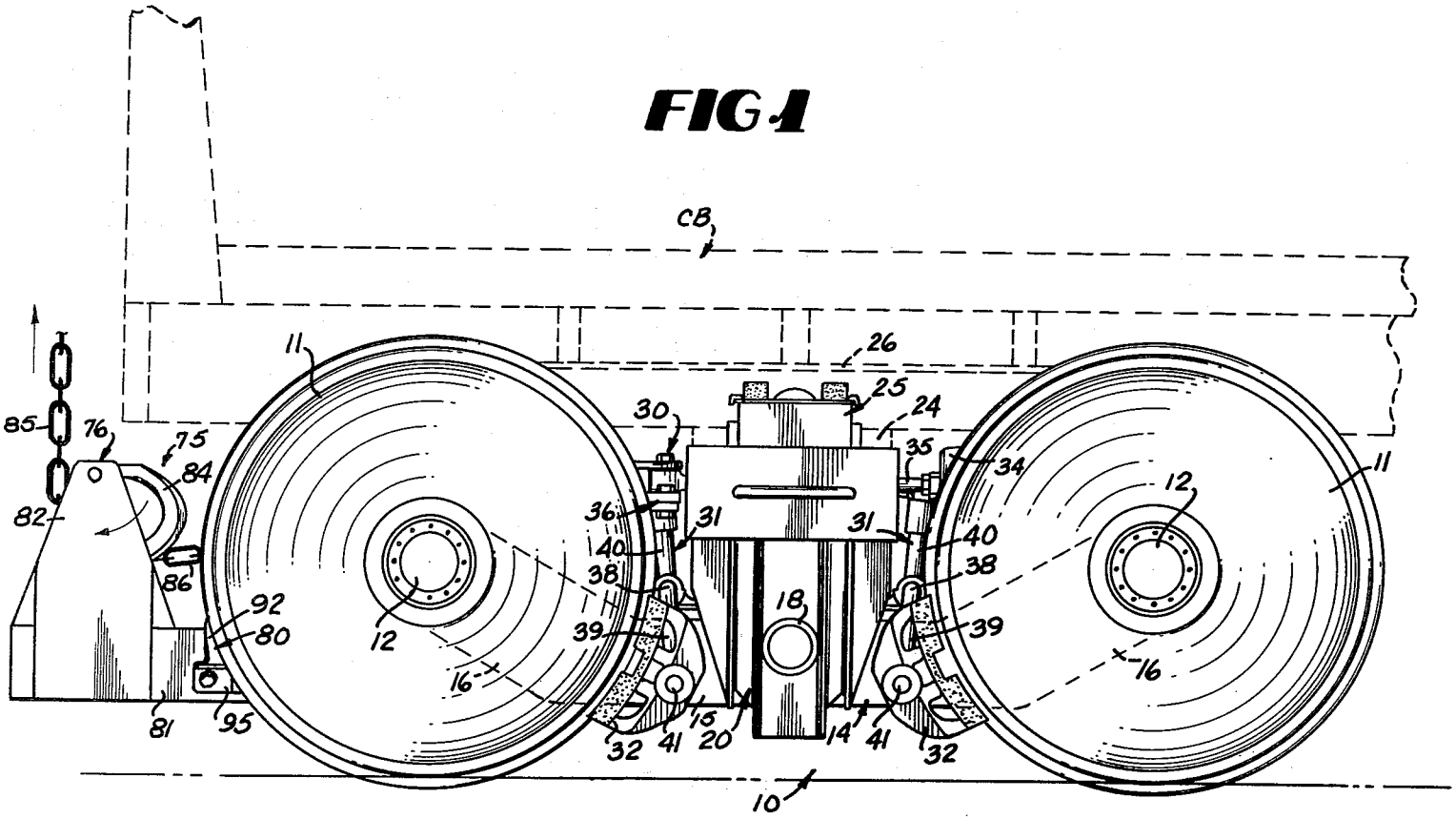
FIG. 1 is a side elevational view of a railway truck embodying the invention.

Referring to the drawings, the railway truck 10 embodying the invention includes flanged track wheels 11 arranged in pairs at the opposite ends of the truck. Each pair of wheels 11 is rotatably journalled on opposite ends of an axle 12 extending therebetween so that the wheels 11 are freely rotatable about the axles 12. The axles 12 are mounted between the opposite ends of a pair of spaced apart side frames 14 extending longitudinally of the truck 10 just inboard of the wheels 11. The axles 12 are mounted to the side frames 14 with appropriate resilient bushings to permit limited pivoting of the axles 12 with respect to each other about the longitudinal axis $A_L$ of the truck 10. The side frames 14 have a generally horizontally oriented central section 15 with upwardly angled end sections 16 integral with opposite ends of the central section 15. The axles 12 are mounted in the upper projected ends of these end sections 16. A transversely extending cross tube 18 extends between the central sections 15 and the side frames 14 and is connected thereto through appropriate resilient bushings so that the side frames 14 can pivot with respect to each other about the cross tube 18. A transversely extending truck bolster 19 extends across the truck 10 above the side frames 14 in a position centered between the two pairs of wheels 11. The truck bolster 19 is connected to the cross tube 18 outboard of the side frames 14 through appropriate spring assemblies 20. The truck bolster 20 is provided with the usual center plate 21 and center pin 22 to provide a rotary connection between the truck 10 and the body bolster 24 on the railway car body CB as seen in FIG. 1. A conventional overbalance roller assembly 25 is mounted on the top of each of the spring assemblies 20 to cooperate with an overbalance bearing plate 26 on the rail car body CB.

A pair of brake assemblies 30 is provided to apply to braking forces to the track wheels 11. One of the brake assemblies 30 is associated with the track wheels 11 on one side of the railway truck 10 while the other brake assembly 30 is associated with the track wheels 11 on the opposite side. Since the brake assemblies 30 have the same construction, only one needs to be described in detail. The brake assembly 30 includes a pair of crank members 31 which mount the brake shoes 32 to engage the wheels 11 on one side of the truck 10, a brake cylinder 34 whose brake rod 35 is connected to the crank members 31 by a linkage assembly 36 so that the brake cylinder 34 can be operated to apply the brake shoes 32 against the periphery of the track wheels 11.

Each of the crank members 31 has a central section 38 with a depending leg 39 integral with one end of the central section 38 and normal thereto, and an upstanding leg 40 integral with the other end of the central section 38 and also oriented normal thereto so that the upstanding and depending legs project from the central section 38 in the opposite directions. The projecting end of the depending leg 39 is provided with a mounting section 41 integral therewith and oriented normal to the depending leg 39 so that the mounting section 41 projects from the depending leg 39 opposite the central section 38 and parallel thereto. One of the crank members 31 is mounted on the side frame 14 adjacent one of the wheels 11 on one side of the truck 10 while the other crank member 31 is mounted on the side frame 14 adjacent the other of the track wheels 11 on the same side of the railway truck 10. Each of the crank members 31 has its central section 38 rotatably journalled and a bearing assembly 42 mounted on top of the side frames 14 so that the crank member 31 is rotatable about the center line of the central section 38 with the central section 38 horizontally oriented normal to the longitudinal axis $A_L$ of the truck 10. The central section 38 extends across the top of the side frame 14 so that the depending leg 39 is located outboard of the side frame 14 between the wheels 11 adjacent the side frame 14 while the upstanding leg 40 is located inboard of the side frame 14. The mounting section 41 is located in the space between the wheels 11 on the side of the truck 10 adjacent the periphery of one of the wheels 11. The brake shoe 32 is mounted on the mounting section 41 so that the brake shoe will engage the periphery of the wheel 11 when the upstanding leg 40 is pivoted away from the axle 12 mounting the wheel 11. Thus, the upstanding leg 40 on one of the crank members 31 projects up on one side of the truck bolster 19 while the upstanding leg 40 of the other crank member 31 projects upwardly on the opposite side of the truck bolster 19. It will thus be seen that, as the upstanding legs 40 on the crank members 31 are pivoted toward each other, the brake shoes 32 will be applied against the periphery of the wheels 11 and moved away from the periphery of wheels 11 as the upstanding legs are pivoted away from each other. For identification purposes, the left crank member 31, as seen in FIG. 3, will be identified as the front crank member $31_F$ while the right crank member seen in FIG. 3 will be identified as the rear crank member $31_R$.

The brake cylinder 34 is mounted on the side frame 14 adjacent the rear crank member $31_R$ on an appropriate bracket 44 so that the brake cylinder 34 is located outboard of the upstanding legs 40 of the crank members 31 and with the brake rod 35 extending from the brake cylinder 34 generally horizontally over the truck bolster 19 and parallel to the longitudinals axis $A_L$ of the truck 10. The brake rod 35 projects over the top of the truck bolster 19 toward the opposide end of the frame 14. The brake cylinder 34 selectively reciprocates the brake rod 35 along its axis as air is supplied to the brake cylinder 34 in conventional manner. The brake rod 35 is illustrated with a length such that the projecting end thereof is located forwardly of the truck bolster 19 adjacent the upstanding leg 40 on the front crank member $31_F$. Guides 45 are provided on the truck bolster 19 to insure that the brake rod 35 does not laterally shift as it is reciprocated by the brake cylinder 34.

The linkage assembly 36 connecting the brake rod 35 with the crank members 31 is mounted on a support assembly 46 carried by the side frame 14 adjacent the front crank member $31_F$. The linkage assembly 36 best seen in FIG. 4 includes a horizontally oriented drive link 48 which is pivotally connected intermediate its ends to the projecting end of the brake rod 35 via drive bolt 49 so that the drive link 49 projects outwardly of brake rod 35 on opposite sides thereof. The lower end of the drive bolt 49 is slidably supported by a horizontal slide plate 50 on the support assembly 40 so that the drive link 48 can move with the brake rod 35. The drive link 48 can pivot with respect to the brake rod 35 about the vertical axis of bolt 49. The upstanding leg 40 of each of the crank members 31 is provided with a drive collar 51 with an outwardly projecting driving ear 52 thereon. The drive collar 51 is also provided with a locking bolt 54 to hold it in place while permitting the drive collar 51 to be adjusted along the length of the upstanding leg 40. The drive collar 51 on the leg 40 of the rear crank member $31_R$ is connected to the inboard end 55 of the drive link 48 with a connecting link 56 which extends over the top of the truck bolster 19 to clear same. One end of the connecting link 56 is pinned to the end 55 of drive link 48 as indicated at bolt 58 to pivot with respect to drive link 48 about a vertical axis while the other end of connecting link 56 is pinned to the driving ear 52 on collar 51 on crank member $31_R$ as indicated at bolt 59 to pivot with respect to ear 52 about a horizontal axis. The length of connecting link 56 may be adjustable as illustrated to faciliate initial setup and maintenance as will become more apparent.

The drive collar 51 on the front crank member $31_F$ is connected to the outboard end 60 of drive link 48 with a motion reversing linkage 61. The linkage 61 includes a horizontally oriented reversing link 62 pivotally connected intermediate its ends by bolt 64 to the support assembly 46 so that link 62 can pivot with respect to assembly 46 about a vertical axis. The opposed ends of reversing link 62 project outwardly on opposite sides of the support assembly 46. The outboard end 65 of reversing link 62 is connected to the outboard end 60 of drive link 48 with a transfer link 66. The transfer link 66 is pinned to the outboard end 60 of drive link 48 as indicated as bolt 68 and to the outboard end 64 of reversing link 62 as indicated at bolt 69 so that link 62 can pivot with respect to both links 48 and 62 about vertical axes. The length of transfer link 66 may be adjustable as indicated. The inboard end 70 of reversing link 62 is connected to the drive collar 51 on crank member $31_F$ with a connecting link 71. One end of connecting link 71 is pinned to the inboard end 70 of reversing link 62 as indicated at bolt 72 to pivot with respect to reversing link 62 about a vertical axis while the other end of connecting link 71 is pinned to the driving ear 52 on collar 51 on crank member $31_F$ as indicated at bolt 74 to pivot with respect to ear 52 about a horizontal axis.

The pinned connection 58 between links 48 and 56 and the pinned connection 68 between links 48 and 66 are spaced equal distances $d_a$ from and on opposite sides of the pivot connection between brake rod 35 and drive link 48 at bolt 49. The pinned connection 69 between links 62 and 66 and the pinned connection 72 between links 62 and 71 are spaced equal distances $d_b$ from and on opposite sides of the pivot connection between reversing link 62 and support assembly 46 at bolt 64. This insures that equal braking forces will be applied to wheels 11 as will become more apparent. It will be appreciated that the pivot connection at bolt 64 between support assembly 46 and reversing link 62 is fixed with respect to side frame 14 while the pivot connection at bolt 49 between brake rod 35 and drive link 48 moves as the brake rod 35 is extended and retracted by the brake cylinder 34.

The linkage 36 is designed to apply the brake shoes 32 to the wheels 11 as the brake rod 35 is extended (moves to the left as seen in the figures). As brake rod 35 is extended, the drive link 48 is moved therewith toward the reversing link 62. This causes the connecting rod 56 to pivot the rear crank member $31_R$ counterclockwise as seen in FIG. 3 to move the brake shoe 32 thereon into engagement with the periphery of wheel 11 associated therewith. As the same time, this causes the transfer link 66 to pivot the reversing link 62 counterclockwise as seen in FIG. 4 about bolt 64 which in turn causes the connecting link 71 to pivot the front crank member $31_F$ clockwise as seen in FIG. 3 to move the brake shoe 32 thereon into engagement with the periphery of wheel 11 associated therewith. Thus, it will be seen that extension of brake rod 35 applies braking forces to both wheels 11 on one side of truck 10.

Preferably, the bolt 64 pivotally connecting the reversing link 62 to the support assembly 46 is located in registration with the path of movement of the brake rod 35 as seen in FIG. 4. The length adjustability of the links 56, 66 and 71 permits the clearance between the brake shoes 32 and wheels 11 when the brakes are released to be adjusted and the pivotal position of links 48 and 62 to be selected to provide the desired range of movement.

Because the drive link 48 is pivoted to the brake rod 35 and the pinned connections 58 and 68 between drive link 48 and the links 56 and 66 are spaced equidistant from the bolt 49, equal forces will be applied to links 56 and 66. Similarly, because the pinned connections 69 and 72 between reversing link 62 and links 66 and 71 are spaced equidistant from the pivot bolt 64, the force applied to link 71 will be the same as the force applied to link 66. Therefore, the force applied to the rear crank member $31_R$ will be equal to the force applied to the front crank member $31_F$. The collars 51 on crank members $31_F$ and $31_R$ are adjusted so that the pinned connection 59 between link 56 and crank member $31_R$ is located the same distance from the pivot axis of crank member $31_R$ as the pinned connection 74 between link 71 and crank member $31_F$ is located from the pivot axis of crank member $31_F$. Thus, the braking force applied to wheels 11 by crank members $31_F$ and $31_R$ are equal. Equal braking forces are maintained even though one of the brake shoes 32 may contact its associated wheel 11 before the other since the drive link 48 will simply pivot about bolt 49 until the braking forces are equalized.

This construction permits the linkage assembly 36 to have a low overall height since the links 48, 56, 62, 66 and 71 can be located in substantially the same horizontal plane. As a result, the brake assembly 30 can be located over the side frame 14 and the truck bolster 19 without interfering with the operation thereof or interfering with the railway car body mounted thereon. At the same time, the space between the side frames 14 is left clear so that the side frames 14 can be interconnected as by the cross tube 18.

Typically, it is necessary to have the capability of manually applying the brakes to at least one of the railway trucks on a railway car to maintain the railway car in position while it is disconnected from the train. The railway car is typically provided with a handwheel operated mechanism (not shown) which can be operated manually to extend and retract an output chain therein. This motion of the output chain can be used to manually apply the brakes as will become more apparent. Since this mechanism is conventional, it need not be described.

Figure 2:
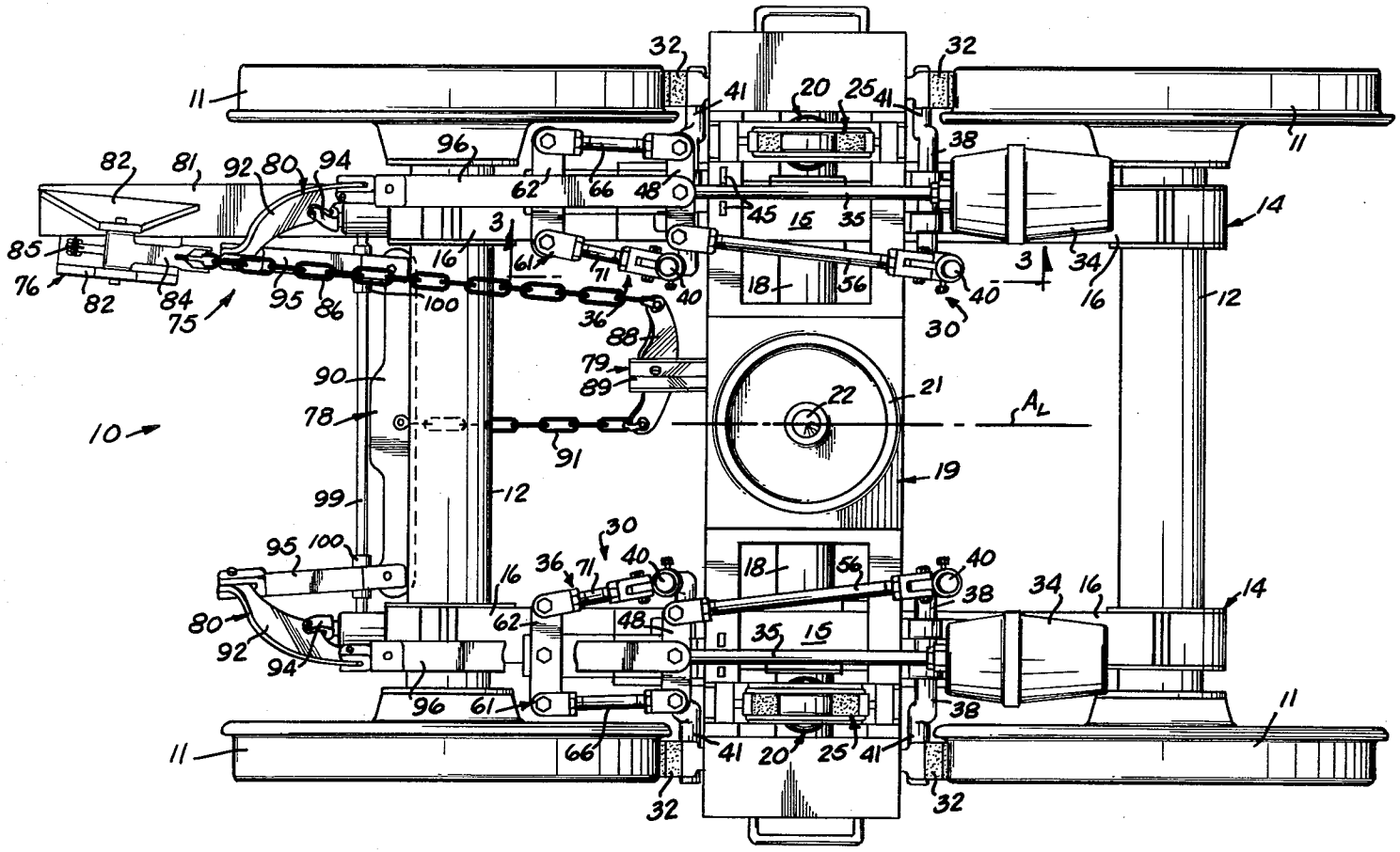
FIG. 2 is a top plan view thereof.

FIGS. 1 and 2 illustrate a hand brake connection assembly 75 for connection to the output chain from the handwheel operated mechanism on the car body to manually apply braking forces to the flanged track wheels 11 through the brake assemblies 30. The hand brake connection assembly 75 includes a drive assembly 76 mounted on the railway truck 10 and removably connected to the handwheel operated mechanism. The output of the drive assembly 76 is connected to a drawbar assembly 78 through a transfer linkage 79 so that operation of the drive assembly 76 moves the drawbar assembly 78. The drawbar assembly 78 is connected to the linkage assemblies 36 in both of the brake assemblies 30 by a pair of hand brake linkage assemblies 80 so that operation of the handwheel mechanism can be used to simultaneously apply the brake shoes 32 of both brake assemblies 30 to the track engaging wheels 11.

The drive assembly 76 is mounted on a support extension 81 fixedly mounted on the end of one of the side rails 14 of truck 10 and projects outwardly therefrom so that the drive assembly 76 is located generally in vertical registration with the handwheel mechanism (not shown) on the rail car body. Typically, this handwheel mechanism is located on the end of the rail car body adjacent one side thereof and thus the drive assembly 76 is located on one side of the railway truck 10. The drive assembly 76 includes a pair of spaced apart pivot plates 82 fixedly mounted on the projecting end of the support extension 81. The pivot plates 82 extend upwardly from the support extension 81 and pivotally amount a drive member 84 between the upper ends thereof about a generally horizontal axis. The drive member 84 is operatively and removably connected to the output chain from the handwheel mechanism through an input link chain 85 so that operation of the handwheel mechanism serves to pivot the drive member 84 about its axis.

The transfer linkage 79 includes an elongate link 88 which is pivotally supported intermediate its ends on a support bracket 89 carried by that side of the truck bolster 19 facing the drive assembly 76. The elongate link 88 is oriented at an angle so that its lower end is generally in vertical registration with the longitudinal axis $A_L$ of the railway truck while its upper end is located just inboard of the side frame 14 mounting the drive assembly 76 thereon. The upper end of the link 88 is connected to the drive member 84 through a transfer link chain 86. The transfer chain 86 is connected to the drive member 84 so that it will be wound around the drive member 84 as it is pivoted clockwise as seen in FIG. 1 by the handwheel operated mechanism. This effectively shortens the length of chain 86 so that the upper end of the link 88 will be pivoted away from the truck bolster 19 and move the lower end of the link 88 toward the truck bolster 19 as the drive member is pivoted clockwise.

The drawbar assembly 78 includes a generally horizontally oriented drawbar 90 which is oriented generally transversely of the longitudinal axis $A_L$ of the railway truck 10 and is movably supported in its horizontal position as will become more apparent. One end of an output chain 91 is pinned to the center of the drawbar 90 with the other end of chain 91 connected to the lower end of the elongate link 88. This causes the drawbar 90 to be moved toward the truck bolster 19 as the transfer link chain 86 is wound around the drive member 84 to move the upper end of the link 88 away from the truck bolster 19. One end of the drawbar 90 is connected to the linkage assembly 36 of one of the brake assemblies 30 through one of the hand brake linkage assemblies 80 while the opposite end of the drawbar 90 is connected to the linkage assembly 36 of the other brake assembly 30 through the other hand brake linkage assembly 80.

Both of the hand brake linkage assemblies 80 have a similar construction and only one needs to be described in detail. Each of the hand brake linkage assemblies 80 includes a pivot link 92 which is pivoted intermediate its ends in a pivot bracket 94 mounted on the projecting end of the side frame 14 above the end of the draw bar 90. The lower end of the pivot bracket 94 is connected to one end of the draw bar 90 through a generally horizontally oriented link 95 while the upper end of the pivot link 92 is connected to the linkage assembly 36 on the brake assembly 30 through an output link 96. The pivot link 92 is angled so that its lower end is located inboard of the side frame 14 while its upper end is located to position the output link 96 generally coaxially of the brake rod 35 of the brake assembly 30. The input link 96 is generally horizontally oriented and is provided with a clevis arrangement 98 at that end connected to the linkage assembly 36. The clevis arrangement 98 extends around the projecting end of the brake rod 35 and is pivotally connected to the drive link 48 of the linkage assembly 36 by the bolt 49 connecting the piston rod 35 to the drive link 48. The input link 96 extends above and over the reversing link 62 in the linkage assembly 36 so as not to interfere with the operation of this link.

The links 95 connecting the pivot links 92 with the opposite ends of the drawbar 90 are movably supported on a cross shaft 99 extending between the side frames 14 under the links 95. Rollers 100 are rotatably mounted on the cross shaft 99 in registration with the links 95 so that the links 95 are maintained generally horizontal as they are moved. This arrangement serves to movably support the drawbar 90 in the horizontal position. It will be appreciated that the pivotal connection between the links 95 and the drawbar 90 are located equidistant on opposite sides of the pinned connection between the drawbar 90 and the output link chain 91 connected thereto. This causes the drawbar 90 to apply equal forces to both hand brake linkage assemblies 80. Since both of the hand brake linkage assemblies 80 have the same construction, equal forces will be applied to the linkage assemblies 36 of the brake assemblies 30.

To manually apply the brakes to the wheels 11 on the truck 10, the handwheel mechanism (not shown) is manually manipulated to cause the input link chain 85 to pivot the drive member 84 clockwise as seen in FIG. 1 to wind the transfer link chain 86 around the drive member 84. This causes the upper end of the reversing link 88 to pivot away from the truck bolster 19 thereby causing the output link chain 91 to move the drawbar 90 toward the truck bolster 19. This causes the pivot links 92 to both be pivoted so that their upper ends are moved away from the truck bolster 19. This in turn causes the output links 96 to move the drive links 48 in the linkage assemblies 36 of both of the brake assemblies 39 similarly to that described when the brake cylinders 34 extend the brake rods 35. This action serves to pivot the drive legs 40 on the crank members 31 on each side of the railway truck 10 toward each other and apply the brake shoes 32 against the periphery of the railway wheels 11. This also serves to extend the brake rods 35 without the air pressure normally used to extend the brake rods 35 being applied to the brake cylinders 34. The motion of the handwheel mechanism (not shown) is reversed to reverse the motion of the hand brake connection assembly 75 when the brakes are to be released. Each of the brake cylinders 34 is provided with an internal spring which serves to retract the piston rods 35 when the air is removed from the brake cylinders 34 or when the hand brake connection assembly 75 is released. The hand brake connection assembly 75 is constructed with an appropriate mechanical advantage so that sufficient braking forces can be applied through the handwheel operated mechanism.

What is claimed as invention is:

1. A railway truck for a railway car body including a pair of spaced apart side frames, each of said frames including a generally horizontally oriented central section and a pair of upwardly angled end sections integral with opposite ends of said central section;

a cross tube extending transversely of and pivotally connecting said central sections of said side frames so that said side frames can pivot with respect to each other about said cross tube;

a pair of axles extending transversely of said side frames with each of said axles resiliently connected between the transversely aligned end portions of said side frames so that said axles are located on opposite sides of said cross tube and generally parallel thereto and so that each of said axles can pivot with respect to each other about a horizontal axis parallel to said side frames;

a pair of railway track engaging wheels rotatably mounted on opposite ends of each of said axles outboard of said side frames;

a truck bolster extending transversely over the central sections of side frames to support the car body thereon;

a pair of spring assemblies resiliently connecting said truck bolster to opposite ends of said cross tube inboard of said wheels;

a pair of brake assemblies, one of said brake assemblies mounted on each of the side frames and applying braking forces to said track engaging wheels adjacent that side frame, each of said brake assemblies comprising:

a pair of crank members pivotally mounted on said central section of said side frame mounting said brake assembly on opposite sides of said truck bolster, each of said crank members including a depending pad mounting portion outboard of said side frame extending into the space between said wheels adjacent that side frame and an upstanding drive portion inboard of said side frame and projecting above said truck bolster;

a brake shoe mounted on the pad mounting portion of each of said crank members so that, as said pair of crank members are pivoted in opposite directions, said brake shoes mounted thereon will engage and brake said track engaging wheels adjacent said side frame;

a brake cylinder mounted on said side frame on one side of said truck bolster and including a horizontally extending brake rod projecting therefrom over said truck bolster and having a projecting end located on that side of said truck bolster opposite said brake cylinder;

a horizontally oriented drive link having opposed ends located on that side of said truck bolster opposite said brake cylinder with the projecting end of said brake rod pivotally connected to said drive link intermediate its ends;

a first connecting link extending over said truck bolster and pivotally connecting one end of said drive link to said drive portion projecting above said truck bolster of said crank member on the same side of said truck bolster as said brake cylinder;

a motion reversing linkage pivotally mounted on said side frame on that side of said truck bolster opposite said brake cylinder, said motion reversing linkage pivotally connecting the other end of said drive link to said drive portion of said crank member on that side of said truck bolster opposite said brake cylinder so that said pair of crank members are pivoted in opposite directions as said brake rod moves said drive link in a first direction to force said brake shoe against the wheels with equal braking force.

2. The railway truck of claim 1 wherein said motion reversing linkage of each of said brake assemblies includes a horizontally oriented reversing link having opposed ends; a transfer link pivotally connecting the other end of said drive link to one end of said reversing link; a second connecting link pivotally connecting the other end of said reversing link to said drive portion of said crank member on that side of said truck bolster opposite said brake cylinder; and mounting means pivotally mounting said reversing link intermediate the ends thereof about a vertical pivot axis fixed with respect to said side frame and equidistant from the pivotal connections of said transfer link and said second connecting link with said reversing link.

3. The railway truck of claim 2 wherein each of said brake assemblies further includes a first drive collar slidably mounted on said drive portion of said crank member on the same side of said truck bolster as said brake cylinder, said first drive collar pivotally connected to said first connecting link and including locking means for selectively fixing said collar to said drive portion at any selected position along the length thereof; and a second drive collar slidably mounted on said drive portion of said crank member on that side of said truck bolster opposite said brake cylinder, said second drive collar pivotally connected to said second connecting link and including locking means for selectively fixing said collar to said drive portion at any selected position along the length thereof.

4. The railway truck of claim 3 for use with the railway car body equipped with a manually operated force applying mechanism further including:

a pair of horizontally oriented output links having opposed ends, one end of one of said output links connected to said drive link in one of said brake assemblies at the same position as said brake rod and extending away from said drive link opposite said brake rod over said reversing link;

a pair of pivot links having upper and lower ends, one of said pivot links pivotally mounted intermediate its ends on the end portion of each of said side frames opposite said brake cylinders, the upper end of each of said pivot links pivotally connected to that end of one of said output links opposite the end connected to said drive link;

a horizontally oriented drawbar member having opposed ends located below said axle at those ends of said side frames mounting said pivot links and extending transversely of said side frames;

a pair of generally horizontally oriented support links, each of said support links pinned between the lower end of one of said pivot links and one end of said drawbar member so that movement of said drawbar member moves both of said output members;

support means movably supporting said support links thereon so that said support links vertically support said drawbar member;

a transfer link having upper and lower ends pivotally mounted intermediate its ends on said truck bolster;

an output chain connecting the lower end of said transfer link to said drawbar member equidistant from the pinned connections between said support links and said drawbar member;

a drive member pivotally mounted on one of said side frames and operatively connected to said manually operated force applying mechanism so that said drive member is pivoted as said force applying mechanism is operated; and a transfer chain connecting said drive member with the upper end of said transfer link so that pivoting of said drive member in a given direction moves said drawbar member and thus said output links whereby said drive links are moved to apply equal braking forces to said wheels.

* * * * *